United States Patent [19]

Carel et al.

[11] 4,070,319

[45] Jan. 24, 1978

[54] SIZING

[75] Inventors: Philippe Robert Raymond Carel, Paris; Rene Paul Auguste Decamp, Villers Saint Paul; Jean Perronin, Chantilly, all of France

[73] Assignee: Produits Chimiques Ugine Kuhlmann, Paris, France

[21] Appl. No.: 557,426

[22] Filed: Mar. 11, 1975

[30] Foreign Application Priority Data

Mar. 11, 1974 France ..... 74 08114

[51] Int. Cl.[2] ..... C08L 33/02

[52] U.S. Cl. ..... 260/29.4 UA; 260/29.6 NR; 260/29.6 TA; 260/29.7 H

[58] Field of Search ..... 260/29.6 NR, 29.6 TA, 260/29.4 UA, 29.7 H; 162/168 R, 168 NA

[56] References Cited

U.S. PATENT DOCUMENTS

| | | | |
|---|---|---|---|
| 3,081,198 | 3/1963 | Miller | 260/29.6 TA |
| 3,107,227 | 10/1963 | Sven et al. | 260/29.4 UA |
| 3,232,899 | 2/1966 | Guziak | 260/29.6 TA |
| 3,296,175 | 1/1967 | Fantl et al. | 260/29.6 TA |
| 3,300,431 | 1/1967 | Veno et al. | 260/29.6 NR |
| 3,352,710 | 11/1967 | Wolf et al. | 260/29.6 TA |
| 3,365,410 | 1/1968 | Wesslau et al. | 260/29.6 TA |
| 3,681,069 | 8/1972 | McNamee et al. | 260/29.6 TA |
| 3,872,039 | 3/1975 | Vaughn et al. | 162/168 R |
| 3,897,375 | 7/1975 | Takahashi et al. | 260/29.7 H |
| 3,925,328 | 12/1975 | Shibahara et al. | 162/168 N |

*Primary Examiner*—M. J. Welsh

*Attorney, Agent, or Firm*—Beveridge, DeGrandi, Kline & Lunsford

[57] ABSTRACT

Sizing bath for a non-woven cellulose based substrate in which the bath has a pH of 2 to 12 and contains as sizing agent at least one anionic latex of at least one copolymer of which the vitreous transition temperature is −40° C. to +120° C. and of which the K value is 55 to 130, the copolymer containing in interpolymerised form:

a. 35% to 80% by weight of at least one ester of acrylic and/or methacrylic acid with an alcohol containing 1 to 18 carbon atoms and/or at least one vinyl ester of a carboxylic acid containing 1 to 18 carbon atoms, b. 20% to 50% by weight of acrylic, methacrylic, crotonic or itaconic acid, or a mixture thereof, c. 0% to 20% by weight of at least one monomer having an ethylene linkage and at least one polar group or containing several ethylene linkages, d. 0% to 30% by weight of at least one halogenated or nonhalogenated hydrocarbon containing at least one double bond and 2 to 18 carbon atoms, the latex containing 20% to 50% by weight of dry material, having a pH of 2 to 7, and having the property of thickening by treatment with alkali; process for the surface sizing of a non-woven, cellulose-based substrate which comprises impregnating the substrate in such a sizing bath and non-woven cellulose-based substrates sized by this process.

13 Claims, No Drawings

SIZING

The present invention concerns sizing and in particular it relates to sizing baths containing one or more anionic copolymers and to a process for sizing the surface of paper and cardboard by means of such baths.

By means of this invention the simultaneous sizing and colouring of the paper or carboard is possible.

To improve the properties of a paper and to make it capable of receiving writing or printing, sizing agents have to be incorporated. These are intended not only to bond the fibres together, but especially to oppose the penetration of the liquids into the paper without however making it too hydrophobic, which would have the disadvantage of making the writing ink to form beads.

In order to obtain a correctly sized paper, natural resins generally based on colophony or related substances have long been used.

In the case of "bulk sizing", these sizes are incorporated in the aqueous suspension of paper pulp and precipitated on to the fibres by the addition of aluminium or iron sulphate. After filtration and spreading out in sheet form, followed by drying an "internally sized paper" is thus obtained. This technique necessitates the use of relatively large quantities of aluminium salts which partly find their way into the waste water and which are in consequence a source of pollution. On the other hand, these sizes, like all natural products, are subject to certain variations in quality and are often a source of difficulty or inconvenience to the papermaker. In addition, leaving aside special cases, this type of sizing can only be effected in acid medium. This considerably favours the corrosion of the material. It also follows that a filler such as chalk (whiter and cheaper than kaolin) cannot be conjointly used. Finally, the presence of these aluminium salts adversely affects fluorescent brightening agents and most dyestuffs.

Beside bulk sizing which forms part of the general know-how of the papermaker, another process of sizing by the application of suitable products to the surface of the paper has been developed. This process called "surface sizing" is applied generally to an unsized paper or to a paper which has been very slightly sized in bulk.

The treatment of "surface sizing" can then be effected on the paper machine or on a separate machine, for example, by means of a sizing press, a calender provided with a water tank or any machine for impregnating, coating, spreading or sprinkling.

The principal sizing agents used in this case were at the beginning, modified starches, polyvinyl alcohols and certain compositions based on waxes, higher alkyl ketenes or higher fatty acids. Modified starches have also been recommended in association with cross-linking agents such as certain aminoplast resins.

Cationic sizing agents have also been proposed since they have the advantage of more or less fixing themselves on the paper fibres. On the other hand, they have the disadvantage of only being compatible with basic dyestuffs whose fastness to light is generally rather indifferent.

In this respect, anionic products are preferable since they are compatible with the fluorescent brightening agents commonly used in papermaking, such as stilbene derivatives, as well as with acid and direct dyestuffs which, contrary to those previously mentioned, have good fastness to light. In addition, since these sizing agents may be used in an alkaline medium, it is possible to use conjointly alkaline fillers, such as chalk, which enable papers to be obtained having an excellent receptivity to the ink and which are therefore particularly adapted to provide offset prints of good quality.

With this in mind, French Pat. No. 1,552,723 proposed copolymers of vinyl ether and maleic anhydride which give interesting results with the condition, however, that papers impregnated first with aluminium or ferric salts are used. French Pat. No. 2,046,525 proposes the use of aqueous dispersions of starch modified by means of vinyl esters of carboxylic acids. Belgian Pat. No. 758,672 proposes combinations of waxes and water-soluble styrene-maleic anhydride copolymers. French Pat. No. 2,104,425 proposes the use of water-soluble copolymers of alpha olefines and acrylic or methacrylic acid obtained by a particular process of polymerisation in an alcoholic medium.

However, according to French Pat. No. 2,150,882 (page 1, lines 12 to 20), it is established that only dispersions and solutions of synthetic resins having a cationic character have a good efficiency for properly sizing the paper. The known anionic polymers or condensates do not have a sufficient sizing effect. For this reason copolymers based on carboxylated maleic imide were proposed, as anionic products, for sizing the paper by superficial impregnation but in order to give to the paper the optimum degree of sizing they must necessarily be used in the form of their alkaline salts at pH 8.

In these conditions, the simultaneous use of an aminoplast resin, such as melamine-formaldehyde or dimethylol dihydroxy ethylene urea condensates becomes impossible since they require an acid catalyst in order to react. It is the same when it is desired to effect simultaneously the sizing and the colouration of the paper with certain basic dyestuffs which can only be used in an acid medium.

We have now found that it is possible to obtain surface sized papers or cardboards by operating in a pH zone which extends from 2 to 12. Consequently it is possible to effect at the same time the fluorescent brightening or colouration of the paper or cardboard not only with acid, direct or substantive dyestuffs, but also with certain basic dyes or pigmentary colouring matters in the presence or absence of aminoplast resins.

According to the present invention a sizing bath for a non-woven cellulose based substrate is provided in which the bath has a pH of 2 to 12 and contains as sizing agent at least one anionic latex of at least one copolymer of which the vitreous transition temperature is −40° C. to +120° C, and of which the K value is 55 to 130, the copolymer containing in interpolymerised form:

a. 35% to 80% by weight of at least one ester of acrylic and/or methacrylic acid with an alcohol containing 1 to 18 carbon atoms and/or at least one vinyl ester of a carboxylic acid containing 1 to 18 carbon atoms.

b. 20% to 50% by weight of acrylic, methacrylic, crotonic or itaconic acid, or a mixture thereof.

c. 0% to 20% by weight of at least one monomer having an ethylene linkage and at least one polar group or containing several ethylene linkages.

d. 0% to 30% by weight of at least one halogenated or non-halogenated hydrocarbon containing at least one double bond and 2 to 18 carbon atoms, the latex containing 20% to 50% by weight of dry material, having a pH of 2 to 7, and having the property of thickening by treatment with alkali.

The invention includes a process for the surface sizing of a non-woven cellulose-based substrate which comprises impregnating the substrate in the above defined bath.

The vitreous transition temperature is preferably 0° C. to 100° C., the percentage by weight of dry material is preferably 25% to 40% and the pH of the latex is preferably 2.5 to 5.5. The K value is determined by the method of H. Fikentscher "Cellulose Chemie", 1932, 13, pp. 58–74.

The latexes according to the invention are aqueous dispersions of finely divided copolymers which on being rendered alkaline thicken and give aqueous solutions or dispersions more viscous than the latex itself.

The copolymers for use in this invention may be obtained, for example, by emulsion copolymerisation of the appropriate monomers in an aqueous phase according to known processes, by means of suitable surface-active compounds and/or colloids and the latter may have an anionic and/or non-ionic character. The following are given by way of example: the alkylsulphates of an alkali metal such as sodium dodecylpolyglycol-ether sulphate and sodium sulphoricinoleate, alkylsulphonates such as the alkali metal salts of sulphonated paraffins, salts of fatty acid such as sodium laurate, triethanolamine oleate or abietate, alkylaryl sulphonates such as sodium dodecylbenzenesulphonate, or the alkali metal sulphates of ethoxylated alkylphenols. Examples of non-ionic emulsifiers are the condensation products of ethylene oxide with fatty alcohols, alkylphenols, polypropyleneglycols, as well as with amines, amides and fatty acids, such as oleyl alcohol condensed with 20 moles of ethylene oxide, or lauryl alcohol or nonylphenol condensed with 10 moles of ethylene oxide. The fatty esters of polyols may also be used, such as the mono-oleate of anhydrosorbitol or the monolaurate of glycerol.

Conjointly with these surface-active compounds, other ingredients well known in the technique of emulsion polymerisation may be used, such as chelating agents, buffers, mineral or organic acid salts, solvents, adjuvants capable of regulating the pH, hydrotropic or stabilising agents.

Examples of esters of acrylic or methacrylic acid which may be used to prepare the copolymers of the invention are, methyl, ethyl, butyl, isobutyl, hexyl or benzyl acrylate, the acrylates of monoalkylethers of ethylene glycol or propyleneglycol and 2-[N-methyl,N-2-perfluorooctyl-ethylsulphonyl]-aminoethyl acrylate, and methyl, butyl, lauryl, stearyl, cyclohexyl, trifluoroethyl methacrylates or polypropyleneglycol monomethacrylate.

Examples of vinyl esters are, vinyl acetate, vinyl propionate, vinyl butyrate, vinyl isobutyrate, vinyl octanoate, vinyl laurate, vinyl stearate, vinyl benzoate or a vinyl ester of an acid known on the market by the name "Versatic acid".

Examples of copolymerisable compounds with an ethylene linkage containing polar groups, are the ethylenic monomers containing for example OH, $NH_2$, NH-alkyl, COOH, COOM (where M = metal), $SO_3H$, $SO_3M$, CN,

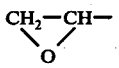

or CHO groups such as the hydroxyalkyl acrylates or methacrylates for example ethyleneglycol monoacrylate or propyleneglycol monomethacrylate, allyloxyethanol, isobutenediol, allyl alcohol, allyl glycollate, acrylamide, methacrylamide, N-(hydroxymethyl) acrylamide, N-isopropyl acrylamide, diacetone acrylamide, ethyl beta-amino-crotonate, dimethylaminoethyl methacrylate, allylamine, vinyl pyridine, senecioic acid or an alkali metal salt thereof, vinylsulphonic acid or an alkali metal salt thereof, styrene-p-sulphonic acid or an alkali metal salt thereof, citraconic anhydride, sodium acrylate, sodium methacrylate, acrylonitrile, methacrylonitrile, 3-amino-crotononitrile, 2-chloro-acrylonitrile, methylene glutaronitrile, isopropyl cyanoacrylate, ethyl 2-cyano-acrylate, glycidyl acrylate, glycidyl methacrylate, allylglycidylether, acryloyl chloride, methylvinylketone, N-vinylpyrrolidone, N-vinylcarbazole and acrolein.

Examples of monomers containing several ethylenic linkages are, for example, allyl acrylate, allyl methacrylate, tetraallyloxy-ethane, the diacrylates or dimethacrylates of ethylene glycol or propyleneglycol, vinyl senecioate, 1,3,5-triacryloylhexahydro-s-triazine, 2-vinyl-4,6-diamino-1,3,5-triazine, glyoxal-bis-acrylamide, trimethylolpropane triacrylate, pentaerythritol tetraacrylate, polyethylene glycol diacrylate, 1,4-butanediol-dimethacrylate, divinyl carbonate, pentaeythritol triallyl ether and divinyl carbinol.

Examples of hydrocarbons which are halogenated or non-halogenated and contain at least one double bond are vinyl chloride, vinylidene chloride, styrene, vinyltoluene, 3-chloro-isobutene, allyl bromide, ethylene, propylene, isobutylene, diisobutylene, isoprene, butadiene, chlorobutadienes, and divinylbenzene.

In order to initiate the polymerisation reaction, a catalyst capable of producing free radicals is used, preferably a peroxygenated compound, such as sodium, ammonium or potassium persulphate, an alkali metal perborate, hydrogen peroxide, cumene hydroperoxide, butyl hydroperoxide, benzoyl peroxide, peracetic acid, an amino-oxide, ceric nitrate or ammonium nitrate. There may be also used as initiators 2,2'-azo-bis-isobutyronitrile, 4,4'-azo-bis-(4-cyanopentanoic acid) or its alkali metal salt. The quantities to be used may vary from 0.01 to 5% with respect to the weight of the monomers to be copolymerised, preferably 0.1% to 0.4%.

The copolymerisation is generally effected at a pH from 7 to 2 and at a temperature of 50° C. to 95° C. although it is possible to operate at higher or lower temperatures. For example, the use of Redox catalysts such as the persulphate-ferrous salt or persulphate-hydroxymethane sodium sulphinate systems may be used to activate the reaction or lower the temperature of the copolymerisation. Finally, provided a suitable apparatus is used, the copolymerisation may be carried out discontinuously, continuously or progressively.

In order to regulate the molecular weight of the copolymers and their K value, determined by measuring the relative viscosity at 20° C. of a 0.5% solution in tetrahydrofuran (H. Gibello - "The vinyl compounds of today", 1953, p-264 and H. Fikentscher - "Cellulose Chemistry", 1932, 13, pp. 58-74), a chain transfer agent may be used, for example an alkylmercaptan such as tertiododecylmercaptan, n-dodecyl-mercaptan, or n-octyl-mercaptan, or carbon tetrachloride, carbon tetrabromide, chloroform, or triphenylmethane. The amounts to be used are a function of the values to be obtained for K. They may go up to 5% with respect to the weight of the monomers and preferably vary between 0.1% and 0.4%.

The proportion of dry material in the dispersion of copolymer which may be used according to the invention may vary within very wide limits. It is advantageous to have a latex of which the proportion of dry material is from 20% to 50%, preferably 25% to 40%.

The term "vitreous transition temperature" refers to transition temperature of the second order which is a specific and characteristic property of each polymer. It is the temperature at which a polymer passed from a rigid vitreous state to a plastic or rubbery state. It corresponds to the change of slope or course of the diagrams representing the variation of certain physical or mechanical properties of the elastomers as a function of the temperature (Bovey, Kolthoff, Medalia, Meeham, page 323 of "Emulsion Polymerisation", 1955). For the copolymers which may be used in the process of the invention, this temperature has been determined by measuring the modulus of rigidity in torsion according to A.S.T.M. D.1043-61T (Corresponding French Standard B.N.M.P. 1005/4).

The latexes thus obtained may be used in the form of aqueous dispersions or aqueous solutions, in an acid, neutral or alkaline medium. The amounts to be used may vary within wide limits, but it has been found that small quantities are often sufficient to obtain the desired effect. Thus, in the sizing baths, an amount of 0.1% to 2% preferably 0.5% to 1%, by weight of a copolymer according to the invention enables suitably sized papers to be obtained. The fact that the pH of the sizing baths giving the desired sizing effect may vary from pH 2to pH 12 is advantageous when it is desired to improve the resistance of paper to wet treatments by adding aminoplast resins such as condensates or precondensates of urea-formaldehyde, melamineformaldehyde, dimethylol-dihydroxyethylene-urea, dimethylolpropylene-urea, or alkyl dimethylol carbamate, which necessitate an acid catalyst. This property also enables the sizing agent and certain dyes to be used in the same bath for effecting simultaneous sizing and colouration. By suitably selecting the dyes and regulating the pH to a suitable value, it is possible to use fluorescent brightening agents, acid, direct or substantive dyestuffs, as well as basic dyestuffs or dispersions of pigmentary colouring matters. For the latter, it may be interesting to use them conjointly with an aminoplast resin in order to obtain special fastness.

Finally, the process according to the invention permits the addition of fillers such as kaolin, talc or titanium oxide generally used in acid medium, but also others, such as calcium carbonate, hydrated alumina, satin white, zinc oxide, lithopone, or organic pigments based on polymethylene-urea or polystyrene, which are used rather in a neutral or alkaline medium.

The latexes of this invention allow the easy preparation of sizing baths by simple dilution with water and the easy production of a suitably sized paper, suitable for writing, and of which the power to absorb water is reduced without it being thereby hydrophobic. These properties are obtained without the necessity of adding, previously or simultaneously in the mass or superficially, sizes of colophony or derivatives thereof, colloids based on starch, aluminum salts, or iron or zinc salts which make practically impossible the simultaneous use of the dispersions of pigmentary colouring matters or acid or substantive dyes.

In the case of paper sized and coloured simultaneously according to the process of the invention, it has been found unexpectedly that the colour yield, the brightness and uniformity of the shades obtained are remarkably good.

Generally, in order to obtain contingently certain effects, the latexes according to the invention may be used in admixture with auxiliary and adjuvant products commonly used in paper-making, such as for example surface-active substances, hygroscopic agents, plasticisers, softeners, fungicides, antifoaming agents, thickeners, colloids (such as casein, dextrin, starch, modified starch, methylcellulose, carboxymethyl-cellulose, polyvinyl alcohol), natural or synthetic binders (such as other copolymers in the form of dispersions or solutions such as styrene-maleic anhydride copolymers, colophony, or derivatives of colophony) water-repelling agents, oil repellants, natural or synthetic waxes, precipitating and clarifying agents, cross-linking agents, intensifiers of resistance to wetting or mineral salts.

The process according to the invention is suitable for the preparation of sized paper of any thickness and of any kind and thus applies to papers or cardboards obtained from mechanical, chemical, soda, sulphite, sulphate, semichemical, wood, natural vegetable, rag or old paper pulp.

The techniques used to size the papers and cardboards by means of the process according to the invention are similar to those which are commonly employed in papermaking.

The invention is illustrated by the following Examples in which the parts indicated are parts by weight and the temperatures are in degrees centigrade. In these Examples the degree of sizing, measured by the absorbent power of the paper with respect to water, is evaluated according to the method of Cobb and Lowe (TAPPI Standard T 441) codified by the Testing Committee of th Central Laboratory of the Swedish Paper industry (Project P.C.A. 13-59), a method which consists in measuring the weight of water absorbed in one minute by a square meter of paper supporting a height of water of one centimeter. The fitness for writing and printing of the paper is estimated by the test described in the bulletin ATIP No. 2 - 1960, pp. 84-91 (P. Philbee) which consists in using standardized inks, numbered 1 to 5, and of increasing power of penetration to make strokes on the paper and determining the maximum number of the ink for which the strokes show neither smudges nor piercing of the paper. The higher this maximum number the better the paper. The resistance to alkalis is determined by measuring the time necessary for the absorption by the paper of a drop of 10% caustic soda (test described in French Pat. No. 1,552,723, page 3).

EXAMPLE 1

By emulsion copolymerisation of a mixture of monomers having the following composition:

| | |
|---|---|
| 43.3 | parts of butyl acrylate |
| 14.3 | parts of vinyl acetate |
| 41.0 | parts of methacrylic acid |
| 1.4 | parts of N-methylol acrylamide |
| 100 | parts |

an anionic latex is prepared having 20% of dry materials and pH 2.8, of a copolymer having a K value of 69 and a vitreous transition temperature of + 65° C. An unsized "AFNOR VII" paper weighing 77 g/m², is impregnated in a sizing bath for a size press, the pH of which is 9 and the composition of which is as follows:

| | |
|---|---|
| 2.25 | g. of the above latex |
| 97.50 | g. of cold water |
| 0.25 | g. of 28% ammonia |
| 100 | g. |

After squeezing with a rate of expression of about 110%, the paper is dried for 3 minutes at 110° C.

A white paper is thus obtained, sized and perfectly suitable for writing. Compared with the untreated paper, the results obtained are as follows:

| | Cobb test (water absorbed in g/m² in 1 minute) | Fitness for writing | |
|---|---|---|---|
| | | smudges | piercing |
| Untreated paper | 160 | 0 | 0 |
| Treated paper | 25 | 5 | 5 |

EXAMPLE 2

By emulsion copolymerisation of a mixture of monomers having the following composition:

| | |
|---|---|
| 53.3 | parts of butyl acrylate |
| 14.3 | parts of vinyl acetate |
| 31.0 | parts of methacrylic acid |
| 1.4 | parts of N-methylol acrylamide |
| 100 | parts |

an anionic latex is prepared with 20% of dry materials and of pH 2.9 of a copolymer having a K value of 79.

The same paper as in Example 1 is impregnated in an impregnation bath of pH 9.1 and with the following composition:

| | |
|---|---|
| 2.25 | g. of the above latex |
| 96.9 | g. of cold water |
| 0.6 | g. of the dyestuff obtained by coupling the diazo derivative of sulphanilic acid with 2-naphthol (C.I. 15 510) |
| 0.25 | g. of 28% ammonia |
| 100 | g. |

After squeezing with arate of expression of about 110% the paper is dried for 20 seconds at 110° C.

There is thus obtained, with a good colour yield, a paper coloured orange with good uniformity of colour, sized and perfectly suitable for writing.

If, in the formula above, the latex according to the invention is replaced by copolymers previously proposed in this art, while keeping the amounts of dry materials the same, results are obtained which are distinctly less good as is shown in the Table below:

| | Cobb test (water absorbed in g/m² in 1 minute) | Fitness for writing | |
|---|---|---|---|
| | | smudges | piercing |
| Untreated paper | 160 | 0 | 0 |
| Paper treated with latex according to the invention | 23 | 5 | 5 |
| Paper treated with ammonium salt of a copolymer containing carboxyl groups | 125 | 4 | 3 |
| Paper treated with dispersion of copolymers based on maleic anhydride | 120 | 0 | 3 |
| Paper treated with dispersion of polyethylene | 130 | 0 | 2 |

EXAMPLE 3

By emulsion copolymerisation of a mixture of monomers having the following composition:

| | |
|---|---|
| 64.3 | parts of butyl acrylate |
| 14.3 | parts of vinyl acetate |
| 20.0 | parts of methacrylic acid |
| 1.4 | parts of N-methylol acrylamide |
| 100 | parts |

an anionic latex is prepared with 20% of dry materials and pH 2.9 of a copolymer having a K value of 88 and a vitreous transition temperature of +9° C.

The same paper as in Example 1 is impregnated in an impregnation bath for a size press, of which the pH is 9.4 and the composition of which is as follows:

| | |
|---|---|
| 2.25 | g. of the above latex |
| 37.5 | g. of cold water |
| 60.0 | g. of a 1% aqueous solution of the dyestuff obtained by coupling one mole of the tetrazo derivative of O-dianisidine with two moles of 8-amino-1-hydroxy-naphthalene-5,7-disulphonic acid (C.I. 24 410) |
| 0.25 | g. of 28% ammonia |
| 100 | g. |

After squeezing with a rate of expression of about 110%, the paper is dried for 20 seconds at 110° C.

There is thus obtained, with a good colour yield, a paper coloured blue with a good uniformity, sized and perfectly suitable for writing.

If, in the above formula, the latex according to the invention is replaced by copolymers proposed previously in this art, while keeping the quantities of dry materials the same, results are obtained which are not so good as is shown in the Table below:

| Paper treated with | Cobb test (water absorbed in g/m² in 1 minute | Fitness for writing | |
|---|---|---|---|
| | | smudges | piercing |
| Latex according to the invention | 22 | 5 | 5 |
| Ammonium salt of a copolymer contaning carboxyl groups | 121 | 4 | 3 |
| Dispersion of copolymers based on maleic anhydride | 122 | 1 | 2 |
| Dispersion of polyethylene | 127 | 3 | 4 |
| Latex of a copolymer of butyl acrylate-vinyl acetate-acrylic acid/54-38-8 | 132 | 4 | 4 |
| Aqueous solution of a sodium polyacrylate | 138 | 0 | 0 |

-continued

| Paper treated with | Cobb test (water absorbed in g/m² in 1 minute | Fitness for writing smudges | piercing |
|---|---|---|---|
| Aqueous solution of an ammonium salt of a styrene-maleic anhydride copolymer | 131 | 4 | 4 |
| Latex of an ethyl acrylate-methacrylic acid/49-51 copolymer | 134 | 1 | 1 |
| Latex of an ethyl acrylate-vinyl chloride/60-40 copolymer | 65 | 2 | 4 |

EXAMPLE 4

By emulsion copolymerisation of a mixture of monomers having the following composition:

| | |
|---|---|
| 35 | parts of butyl acrylate |
| 13.6 | parts of vinyl acetate |
| 50 | parts of methacrylic acid |
| 1.4 | parts of N-methylol acrylamide |
| 100 | parts |

an anionic latex is prepared with 20.7% of dry materials and pH 2.8, of a copolymer having a K value of 59 and a vitreous transition temperature of +70° C.

The same paper as in Example 1 is impregnated in a sizing bath for a size press, the pH of which is 8.6 and the composition of which is as follows:

| | |
|---|---|
| 4.3 | g. of the above latex |
| 1.5 | g. of a 30% aqueous dispersion of the α-form of copper phthalocyanine, |
| 93.7 | g. of cold water |
| 0.5 | g. of 28% ammonia |
| 100 | g. |

After squeezing with a rate of expression of about 110%, the paper is subjected to thermal treatment for 20 seconds at 110° C.

There is thus obtained with a good colour yield a blue paper with a good uniformity of colour, sized and perfectly suitable for writing as proved by the results obtained in the usual tests and set out in the following Table:

| | Cobb test (water absorbed in g/m² in 1 minute | Fitness for writing smudges | piercing |
|---|---|---|---|
| Untreated paper | 160 | 0 | 0 |
| Treated paper | 25 | 5 | 5 |

EXAMPLE 5

By emulsion copolymerisation of a mixture of monomers having the following composition:

| | |
|---|---|
| 64.3 | parts of butyl acrylate |
| 14.3 | parts of vinyl acetate |
| 20.0 | parts of methacrylic acid |
| 1.4 | parts of N-methylol acrylamide |
| 100 | parts |

an anionic latex is prepared having 30% of dry material and pH 2.9 of a copolymer having a K value of 88 and a vitreous transition temperature of +9° C.

The same paper as in Example 1 is impregnated in a sizing bath for a size press, of which the pH is 5.5 and the composition of which is as follows:

| | |
|---|---|
| 3 | g. of the above latex |
| 37.0 | g. of cold water |
| 60.0 | g. of a 0.25% aqueous solution of rhodamine B (C.I. 45 170) (This solution is added after adjusting the pH to 6.7 by the addition of ammonia) |
| 100.00 | g. |

After squeezing with a rate of expression of about 110%, the paper is dried for 3 minutes at 110° C.

There is thus obtained, with a good colour yield, a red paper with a good uniformity of colour.

If, under the same conditions, the rhodamine B is replaced by the same quantity of dyestuff C.I. 44 040, a paper coloured blue is obtained, and if under the same conditions, the 0.15 g. of rhodamine B are replaced by 0.075 g. of auramine (C.I. 41 000), a paper coloured yellow is obtained.

These papers are sized and perfectly suitable for writing as proved by the results obtained according to the usual tests and set out in the Table below. In addition they offer a good resistance to alkaline solutions.

| Paper | Cobb test (water absorbed in g/m² in 1 minute) | Fitness for writing smudges | piercing | Resistance to 10% soda (minutes) |
|---|---|---|---|---|
| Untreated paper | 160 | 0 | 0 | 5 sec. |
| Paper sized and coloured red | 23 | 5 | 5 | 55 min. |
| Paper sized and coloured blue | 25 | 5 | 5 | 120 min. |
| Paper sized and coloured yellow | 22 | 5 | 5 | 85 min. |

EXAMPLE 6

By emulsion copolymerisation of a mixture of monomers having the following composition:

| | |
|---|---|
| 43 | parts of butyl acrylate |
| 14 | parts of vinyl acetate |
| 41 | parts of methacrylic acid |
| 2 | parts of ethylene glycol dimethacrylate |
| 100 | parts |

an anionic latex is prepared having 20.5% of dry materials and pH 2.5, of a copolymer having a K value of 62 and a vitreous transition temperature of 67° C.

The same paper as in Example 1 is impregnated in a sizing bath for a size press, of which the pH is 9 and the composition of which is as follows:

| | |
|---|---|
| 4.4 | g. of the above latex |
| 94.6 | g. of water |
| 0.5 | g. of a powder containing 80% of alkaline agents ($Na_2CO_3$) and 20% of stilbene bis-4,4'-{[di(β-hydroxyethyl)-2-amino-4-phenylamino]-6-s-triazine-amino}-2,2'-disulphonic acid |
| 0.5 | g. of 28% ammonia |

After squeezing with a rate of expression of about 110%, the paper is subjected to thermal treatment for 20 seconds at 110° C.

A sized paper is thus obtained which is optically whitened with a good yield and perfectly suitable for writing, as is shown in the following results:

| | Cobb test (water absorbed in g/m² in 1 minute) | Fitness for writing | |
|---|---|---|---|
| | | smudges | piercing |
| Untreated paper | 160 | 0 | 0 |
| Treated paper | 32 | 5 | 5 |

EXAMPLE 7

By emulsion copolymerisation of a mixture of monomers having the following composition:

| | |
|---|---|
| 53.3 | parts of heptyl acrylate |
| 14.3 | parts of vinyl acetate |
| 31.0 | parts of methacrylic acid |
| 1.4 | parts of N-methylol acrylamide |
| 100 | parts |

An anionic latex A is prepared with 21% of dry materials and pH 2.7, of a copolymer having a K value of 81.

The same paper as in Example 1 is impregnated in a sizing bath for a size press, of which the pH is 8.9 and the composition of which is as follows:

| | |
|---|---|
| 4.3 | g. of the latex A above |
| 25.2 | g. of cold water |
| 10.0 | g. of 10% aqueous solution of an oxidised potato starch which has previously been baked for 20 minutes at 80° C. |
| 60.0 | g. of a 1% aqueous solution of the dyestuff of Example 2 |
| 0.5 | g. of 28% ammonia |
| 100 | g. |

After squeezing with a rate of expression of about 110%, the paper is subjected to thermal treatment for 20 seconds at 110° C.

There is thus obtained, with a good colour yield, an orange paper with good uniformity of colour, sized and prefectly suitable for writing.

Good results are also obtained on replacing in the above bath the 4.3 g. of latex A by an equivalent amount of a latex B, with 21% of dry materials and pH 2.6, of a copolymer having a K value of 95, this latex being prepared by emulsion copolymerisation of a mixture of monomers having the following composition:

| | |
|---|---|
| 45.2 | parts of butyl acrylate |
| 13.8 | parts of vinyl acetate |
| 41.0 | parts of methacrylic acid |
| 100 | parts |

The papers obtained under these conditions have the following characteristics:

| Paper | Cobb test (water absorbed in g/m² in 1 minute) | Fitness for writing | |
|---|---|---|---|
| | | smudges | piercing |
| Untreated paper | 160 | 0 | 0 |
| Paper treated with latex A | 19 | 5 | 5 |
| Paper treated with latex B | 26 | 5 | 5 |

EXAMPLE 8

By emulsion copolymerisation of a mixture of monomers having the following composition:

| | |
|---|---|
| 53.3 | parts of butyl acrylate |
| 31.0 | parts of methacrylic acid |
| 14.3 | parts of acrylonitrile |
| 1.4 | parts of N-methylol acrylamide |
| 100 | parts |

an anionic latex is prepared having 20% of dry materials and pH 3.5, of a copolymer having a K value of 123.

The same paper as in Example 1 is impregnated in a sizing bath for a size press, of which the pH is 2.7 and the composition of which is as follows:

| | |
|---|---|
| 4.5 | g. of the above latex |
| 34.55 | g. of cold water |
| 0.45 | g. of a 65% aqueous solution of a pre-condensate of trimethylated hexamethylol-melamine |
| 60. | g. of a 1% aqueous solution of the dyestuff of Example 2 |
| 0.5 | g. of lactic acid in 80% aqueous solution |
| 100 | g. |

After squeezing with a rate of expression of about 110%, the paper is subjected to thermal treatment for 3 minutes at 110° C.

There is thus obtained with a good colour yield, an orange paper with a good uniformity of colour, sized, perfectly suitable for writing and resistant to alkaline solutions, as is proved by the results obtained in the usual tests and set out in the following Table:

| Paper | Cobb test (water absorbed in g/m² in 1 minute) | Fitness for writing | | Resistance to 10% soda (minutes) |
|---|---|---|---|---|
| | | smudges | piercing | |
| Untreated paper | 160 | 0 | 0 | 5 secs. |

-continued

| Paper | Cobb test (water absorbed in g/m² in 1 minute) | Fitness for writing smudges | Fitness for writing piercing | Resistance to 10% soda (minutes) |
|---|---|---|---|---|
| Treated paper | 21 | 5 | 5 | 120 mins. |

On replacing the above melamine condensate by an equivalent amount of dimethylol dihydroxyethylene urea, identical results are obtained.

EXAMPLE 9

By emulsion copolymerisation of a mixture of monomers having the following composition:

| | |
|---|---|
| 42.4 | parts of butyl acrylate |
| 14.3 | parts of vinyl acetate |
| 32.4 | parts of methacrylic acid |
| 1.4 | parts of N-methylol acrylamide |
| 9.5 | parts of styrene |
| 100 | parts |

an anionic latex is prepared having 20% of dry materials and pH 2.9, of a copolymer having a K value of 93.

The same paper as in Example 1 is impregnated in a sizing bath for a size press, of pH 8.9 and a composition as follows:

| | |
|---|---|
| 6 | g. of the above latex |
| 33.5 | g. of cold water |
| 60 | g. of a 1% aqueous solution of the dyestuff of Example 2 |
| 0.5 | g. of 28% ammonia |
| 100 | g. |

After squeezing with a rate of expression of about 110%, the paper is subjected to thermal treatment for 20 seconds at 110° C.

There is obtained, with a good colour yield, an orange paper having a good uniformity of colour, sized and perfectly suitable for writing as is proved by the following results:

| Paper | Cobb test (water absorbed on g/m² in 1 minute) | Fitness for writing smudges | Fitness for writing piercing |
|---|---|---|---|
| Untreated paper | 160 | 0 | 0 |
| Treated paper | 30 | 5 | 5 |

EXAMPLE 10

By emulsion copolymerisation of a mixture of monomers having the following composition:

| | |
|---|---|
| 53.3 | parts of hexyl acrylate |
| 14.3 | parts of vinyl acetate |
| 31.0 | parts of methacrylic acid |
| 1.4 | parts of N-methylol acrylamide |
| 100 | parts |

an anionic latex is prepared, having 20% of dry materials and pH 2.8, of a copolymer having a K value of 81.

The same paper as in Example 1 is impregnated in an impregnation bath of pH 4.7 and the composition of which is as follows:

| | |
|---|---|
| 4.5 | g. of the above latex |
| 35.5 | g. of cold water |
| 60 | g. of a 1% aqueous solution of the dyestuff of Example 2 |
| 100 | g. |

After squeezing with a rate of expression of about 110% the paper is subjected to thermal treatment for 20 seconds at 110° C.

There is thus obtained a paper coloured orange, sized and suitable for writing, as shown by the results of the usual tests:

| | | |
|---|---|---|
| | Cobb test | = 23 |
| Writing test | smudges | = 5 |
| | piercing | = 5 |

EXAMPLE 11

By emulsion copolymerisation of a mixture of monomers having the following composition:

| | |
|---|---|
| 53.3 | parts of butyl acrylate |
| 5.0 | parts of crotonic acid |
| 26.0 | parts of methacrylic acid |
| 14.3 | parts of vinyl acetate |
| 1.4 | parts of N-methylol acrylamide |
| 100 | parts |

an anionic latex C is prepared having 20% of dry materials and pH 2.6, of a copolymer having a K value of 100.

The same paper as in Example 1 is impregnated in an impregnation bath of pH 7 and with a composition as follows:

| | |
|---|---|
| 4.5 g. | of the above latex |
| 32.1 g. | of cold water |
| 60 g. | of a 1% aqueous solution of the dyestuff of Example 2 |
| 3.4 g. | of a 10% aqueous solution of triethanolamine |
| 100 g. | |

After squeezing with a rate of expression of about 110% the paper is subjected to thermal treatment for 20 seconds at 110° C.

There is thus obtained an orange paper, sized and suitable for writing. The results of the usual tests are as follows:

| | | |
|---|---|---|
| | Cobb test | : 22 |
| Writing test | smudges | : 5 |
| | piercing | : 5 |

The same results are obtained on replacing in the bath the 4.5 g. of latex C above by the same amount of a latex D, having 20% of dry materials and pH 2.7 of a copolymer having a K value of 86, which latex is prepared by emulsion copolymerisation of a mixture of monomers having the following composition:

| | |
|---|---|
| 53.3 | parts of butyl acrylate |
| 14.3 | parts of vinyl acetate |
| 1.0 | parts of itaconic acid |

-continued

| | |
|---|---|
| 30.0 | parts of methacrylic acid |
| 1.4 | parts of N-methylol acrylamide |
| 100 | parts |

EXAMPLE 12

By emulsion copolymerisation of a mixture of monomers having the following composition:

| | |
|---|---|
| 53.3 | parts of butyl methacrylate |
| 14.3 | parts of vinyl acetate |
| 31.0 | parts of methacrylic acid |
| 1.4 | parts of N-methylol acrylamide |
| 100 | parts |

an anionic latex E is prepared having 20% of dry materials and pH 2.6, of a copolymer having a K value of 92.

The same paper as in Example 1 is impregnated in an impregnation bath of pH 12 and with the following composition:

| | | |
|---|---|---|
| 6 | g. | of the above latex |
| 30 | g. | of cold water |
| 60 | g. | of a 1% aqueous solution of the dyestuff of Example 2 |
| 4 | g. | of a 10% aqueous solution of soda |
| 100 | g. | |

After squeezing with a rate of expression of about 110% the paper is subjected to thermal treatment for 20 seconds at 110° C.

There is thus obtained an orange paper, sized and suitable for writing.

The results of the tests of the paper thus obtained are as follows:

| Paper | Cobb test (water absorbed in g/m² in 1 minute) | Fitness for writing | |
|---|---|---|---|
| | | smudges | piercing |
| Untreated paper | 160 | 0 | 0 |
| Paper treated with latex E | 26 | 4 | 5 |

EXAMPLE 13

By emulsion copolymerisation of a mixture of monomers having the following composition:

| | |
|---|---|
| 65.7 | parts of butyl acrylate |
| 14.3 | parts of vinyl acetate |
| 20.0 | parts of acrylic acid |
| 100 | parts |

an anionic latex is prepared, having 20% of dry materials and pH 2.4, of a copolymer having a K value of 113.

The same paper as in Example 1 is impregnated in an impregnation bath of which the pH is 9.6 and the composition of which is as follows:

| | |
|---|---|
| 9 g | of the above latex |
| 30 g. | of cold water |
| 60 g. | of 1% aqueous solution of the dyestuff of Example 2 |
| 1 g. | of 28% ammonia |
| 100 g. | |

After squeezing with a rate of expression of about 110%, the paper is subjected to thermal treatment for 20 seconds at 11 0° C.

An orange-coloured paper is thus obtained, which is sized and suitable for writing. The results of the usual tests are as follows:

| | | |
|---|---|---|
| | Cobb test | : 44 |
| Writing test | smudges | : 4 |
| | piercing | : 3 |

EXAMPLE 14

The same paper as in Example 1 is impregnated in a sizing bath for a size press, the pH of which is 7.5 and the composition of which is as follows:

| | | |
|---|---|---|
| 4.5 | g. | of the latex of Example 10 |
| 30.32 | g. | of cold water |
| 60.0 | g. | of 1% aqueous solution of the dyestuff of Example 2 |
| 0.18 | g. | of 28% ammonia |
| 5.0 | g. | of precipitated calcium carbonate |
| 100 | g. | |

After squeezing with a rate of expression of about 110%, the paper is subjected to thermal treatment for 3 minutes at 110° C.

There is thus obtained a loaded paper, coloured orange, sized and suitable for writing. The results of the usual tests are as follows:

| | | |
|---|---|---|
| | Cobb test | : 27 |
| Writing test | smudges | : 5 |
| | piercing | : 5 |

EXAMPLE 15

The same paper as in Example 1 is impregnated in a sizing bath for a size machine, of which the pH is 6.0 and the composition of which is as follows:

| | | |
|---|---|---|
| 4.5 | g. | of the latex of Example 10 |
| 34.5 | g. | of cold water |
| 60.0 | g. | of 1% aqueous solution of the dyestuff of Example 2 (this solution is added after adjusting the pH to 6.2 by the addition of ammonia) |
| 1.0 | g. | of kaolin |
| 100 | g. | |

After squeezing with a rate of expression of about 110%, the paper is subjected to thermal treatment for 3 minutes at 110° C.

There is thus obtained a loaded paper of orange colour, sized and suitable for writing. The results of the usual tests are as follows:

| | | |
|---|---|---|
| | Cobb test | : 27 |
| Writing test | smudges | : 5 |
| | piercing | : 5 |

We claim:

1. Sizing bath for a non-woven cellulose based substrate in which the bath has a pH of 2 to 12 and contains as sizing agent at least one anionic latex of at least one copolymer of which the vitreous transition temperature is −40° C to +120° C and of which the K value is 55 to 130, the copolymer containing in interpolymerized form:

a. 35% to 80% by weight of at least one ester of acrylic and/or methacrylic acid with an alcohol containing 1 to 18 carbon atoms and/or at least one vinyl ester of a carboxylic acid containing 1 to 18 carbon atoms, b. 20% to 50% by weight of acrylic, methacrylic, crotonic or itaconic acid, or a mixture thereof, c. 0% to 20% by weight of at least one monomer having an ethylene linkage and at least one polar group or containing several ethylene linkages, d. 0% to 30% by weight of at least one halogenated or non-halogenated hydrocarbon containing at least one double bond and 2 to 18 carbon atoms, the latex having a pH of 2 to 7, and having the property of thickening by treatment with alkali, the amount of copolymer in said bath being 0.1% to 2% by weight.

2. Sizing bath according to claim 1 wherein the vitreous transition temperature is 0° C. to 100° C.

3. Sizing bath according to claim 1 wherein the latex contains 25% to 40% by weight of copolymer.

4. Sizing bath according to claim 1 wherein the pH of the latex is 2.5 to 5.5.

5. Sizing bath according to claim 1 wherein the copolymer is a copolymer of acrylic ester, vinyl acetate and methacrylic acid.

6. Sizing bath according to claim 1 wherein the copolymer is a copolymer of acrylic ester, vinyl acetate, methacrylic acid and N-methylol acrylamide.

7. Sizing bath according to claim 1 wherein the copolymer is a copolymer of acrylic ester, methacrylic acid, acrylonitrile and N-methylol acrylamide.

8. Sizing bath according to claim 6 wherein the copolymer is a copolymer of butyl acrylate, vinyl acetate, methacrylic acid and N-methylol acrylamide.

9. Sizing bath according to claim 1 containing, in addition, an aminoplast resin.

10. Sizing bath according to claim 1 wherein the amount of copolymer is 0.5% to 1% by weight.

11. Sizing bath according to claim 1 containing, in addition 0.1% to 0.6% of a dyestuff or fluorescent brightening agent.

12. Sizing bath according to claim 11 wherein the dyestuff is an acid, direct, basic, or pigmentary dyestuff.

13. Sizing bath according to claim 1 containing, in addition, 1% to 5% of a filler.

* * * * *